United States Patent [19]

Chesnut et al.

[11] Patent Number: 4,888,899

[45] Date of Patent: Dec. 26, 1989

[54] MAGAZINE FOR HOUSING CARTRIDGES USING A SPIRALLY WOUND CONFORCE SPRING

[75] Inventors: M. Gaines Chesnut, Kremmling; W. Lawrence Wood, Lakewood, both of Colo.

[73] Assignee: Ram-Line, Inc., Golden, Colo.

[21] Appl. No.: 218,109

[22] Filed: Jul. 12, 1988

Related U.S. Application Data

[63] Continuation-in-part of Ser. No. 34,328, Apr. 3, 1987, abandoned.

[51] Int. Cl.[4] ..... F41C 25/02

[52] U.S. Cl. ..... 42/50

[58] Field of Search ..... 42/7, 18, 22, 50

[56] References Cited

U.S. PATENT DOCUMENTS

| | | | |
|---|---|---|---|
| 1,833,862 | 11/1931 | Schmeisser | 42/50 |
| 2,620,582 | 12/1952 | Stukas | 42/50 |
| 2,777,235 | 1/1957 | Hopkins | 42/50 |
| 3,087,270 | 4/1963 | Stoner | 42/50 |
| 3,399,480 | 9/1968 | Rowe, Jr. | 42/50 |
| 3,619,929 | 11/1971 | Fremont | 42/50 |
| 4,127,954 | 12/1978 | Hausmann | 42/50 |
| 4,509,283 | 4/1985 | Chesnut | 42/50 |
| 4,566,212 | 1/1986 | Chesnut | 42/50 |
| 4,580,364 | 4/1986 | Vyprachticky | 42/50 |
| 4,586,281 | 5/1986 | Chesnut | 42/50 |
| 4,672,760 | 6/1987 | Chesnut et al. | 42/50 |
| 4,765,081 | 8/1988 | Dieringer | 42/50 |
| 4,776,122 | 10/1988 | Dieringer et al. | 42/50 |

FOREIGN PATENT DOCUMENTS

| | | | |
|---|---|---|---|
| 635534 | 11/1963 | Belgium | 42/50 |
| 3305772 | 9/1983 | Fed. Rep. of Germany | 42/50 |
| 147379 | 10/1954 | Sweden | 42/50 |
| 406904 | 8/1966 | Switzerland | 42/50 |

*Primary Examiner*—Charles T. Jordan

*Attorney, Agent, or Firm*—Sheridan, Ross & McIntosh

[57] ABSTRACT

A magazine for housing cartridges, preferably nine millimeter cartridges, is disclosed and includes, as part of the follower assembly, a spirally wound conforce spring unit, preferably comprising a plurality of separate but attached conforce springs. In a preferred embodiment, the magazine includes a conventional-in-length body, which has been modified by providing an elongated rib on the inside surface of a first side wall of the body. A wound portion of the spiral spring unit is located off-center and adjacent to an end portion of a follower body. An unwound portion of the spring unit is located adjacent to the first side wall of the magazine body. The rib acts to prevent contact between the unwound spring unit portion and the cartridges housed in the magazine. In a preferred embodiment, the follower body has a substantially compound support surface whereby two adjacent cartridges contact each other and the support surface of the follower body to prevent or reduce rotational-type movement of the follower body. In one embodiment of the magazine a number of latch areas are also provided so that the magazine can be used with different styles of firearms.

19 Claims, 6 Drawing Sheets

MAGAZINE FOR HOUSING CARTRIDGES USING A SPIRALLY WOUND CONFORCE SPRING

This application is a continuation-in-part of U.S. patent application Ser. No. 07/034,328, filed Apr. 3, 1987, now abandoned.

FIELD OF THE INVENTION

This invention relates to a magazine for housing cartridges to be used with a firearm and, in particular, a magazine for housing nine millimeter cartridges that utilizes a follower assembly that includes a spirally wound conforce spring that provides uniform force to the cartridges as they move through the magazine.

BACKGROUND OF THE INVENTION

Various kinds of cartridge magazines have been proposed or devised for different firearms or weapons. These magazines include differently configured follower assemblies, which are used to support and move the cartridges in the magazine between a bottom end and a top end thereof. In the case of the conventional magazine for housing nine millimeter cartridges, the follower assembly includes a compression spring. When in its fully compressed state with the magazine full of cartridges, the compression spring occupies a certain amount of space. A cartridge magazine that discloses the use of a compression spring as part of the follower is disclosed in U.S. Pat No. 2,620,582 to Stukas, issued Dec. 9, 1952, and entitled "Firearm Magazine." Because of the space occupied by the compression spring when compressed, relatively fewer cartridges can be loaded for containment in such a conventional magazine. The present invention involves the use of a negator or spirally wound conforce spring as part of the follower assembly. Because of the spirally wound conforce spring, an essentially conventional-in-length body of a magazine, preferably a nine millimeter magazine, is able to house two more rounds or bullets than can be housed using the conventional follower assembly that includes a compression spring.

A spirally wound conforce spring has been used as part of the follower assembly in certain magazines. U.S. Pat. No. 4,509,283 to Chesnut, issued Apr. 9, 1985, and entitled "Cartridge Clip," as well as patents cited therein, discloses the use of a spirally wound conforce spring. The spring unwinds along an end wall of the magazine and adjacent to the rim ends of the cartridges. A spirally wound spring provided in a cartridge magazine is also disclosed in Belgium Pat. No. 635,534, issued Nov. 18, 1963. From the patent drawings, there is no rib formed in the magazine. Consequently, there is no means for preventing contact between the unwound spring portion and the cartridges. And there is, therefore, no space or gap continuously maintained between all of the cartridges and the unwound spring portion. This magazine also houses only a single column of cartridges. A magazine for housing a double column of cartridges with ribs formed in the side walls of the magazine is disclosed in U.S. Pat. No. 3,087,270 to Stoner, issued Apr. 30, 1963, and entitled "Ammunition Magazine With a Coil Spring." However, the ribs are not located to prevent contact between cartridges and unwound spring portion; rather, the ribs engage the nose ends of the cartridges to keep them in some desired alignment. Additionally, there is only a single layer of conforce spring centered, not offset, relative to the follower body. With regard to disclosures relating to the use of a single magazine with a plurality of differently styled but related firearms, U.S. Pat. No. 4,586,281 to Chesnut, issued Mar. 8, 1985, and entitled "Cartridge Magazine For Use With A Plurality Of Firearms" describes a magazine with a number of different latch-related elements.

Although it is known to incorporate a spirally wound conforce spring in a cartridge magazine as part of the follower assembly, such prior art is not concerned with identifying and solving the problems that were presented in arriving at the present invention. In order to provide a properly functioning magazine, it is important to properly locate or position the spirally wound conforce spring in the conventional-in-length body of the nine millimeter magazine. In that regard, it was necessary to identify where the spring could be located relative to the body and the follower, as well as providing, in at least some embodiments, a nesting area or pocket for the unwound portion of the spring. The selected spring location assists in providing a desired "nose up" condition for the cartridges while the nesting area prevents frictional engagement between the spring and the magazine body. In addition, the use of the spirally wound conforce spring resulted in the cartridges contained in the body of the magazine being relatively loose, which caused unwanted small amounts of movement or rattling noises, and this problem is solved by an embodiment of the present invention. Also, a sufficiently strong conforce spring configuration had to be devised and implemented because of the problem encountered in moving cartridges with a single conforce spring. Furthermore, the latch areas of the present inventive magazine had to be determined and incorporated so that the magazine could be used in different firearms.

SUMMARY OF THE INVENTION

The cartridge magazine of the present invention is used to house or contain a number of cartridges, preferably a double column of nine millimeter cartridges. The magazine includes a body, which is essentially conventional in length and, before the present invention, was only used in combination with a follower assembly that included a compression spring, and not a spirally wound conforce spring. The follower assembly of the present invention, which is contained within the body of the magazine, includes a follower body and the spirally wound conforce spring. In one embodiment, the follower body is quite comparable to a conventional or known piece, which has previously been used in the conventional nine millimeter magazine. An important difference found in the present invention from the conventional nine millimeter magazine lies in the use and location of a spirally wound conforce spring. In particular, a first free end of the spring is attached by a rivet, weld, or the like to a side wall of the body of the magazine. The attachment point is adjacent to an end wall of the magazine body which contacts, or which is adjacent to, the nose ends of the cartridges. Portions of the spring opposite the attached free end are spirally wound and located at the bottom surface of the follower body opposite the upper surface which contacts cartridges. Additionally, the spirally wound portion is located at one end portion of the follower body, namely, that end portion which is adjacent to the nose ends of the cartridges.

In a preferred embodiment, the conforce spring is actually comprised of a number of individual springs. The use of two conforce springs is preferred. In one embodiment, three conforce springs that are attached together at one of their free ends to the magazine body is provided. The wound and unwound portions of each of the springs extend together adjacent each other. The combination of a number of springs ensures sufficient force to move the follower body and the cartridges in the magazine body.

The conventional body of the magazine has also been modified to solve a problem relating to unwanted slight movements of the cartridges in the magazine resulting in undesirable noises. Specifically, the body of the magazine in one embodiment includes a protrusion or rib located on the inside surface of a side wall of the body. The side wall having the rib is opposite the side wall to which the spring is attached. The rib is elongated and extends substantially the same length as the length of the unwound portion of the spring when the magazine is completely loaded with cartridges. Preferably, the elongated rib is directly opposite this unwound portion of the spring to provide symmetry that would not otherwise be present within the magazine body because of the rib. The rib acts to prevent, or at least reduce, the magnitude of cartridge movement that resulted from the incorporation of the spirally wound conforce spring.

In a preferred embodiment of the magazine, a rib is provided on the same side wall along which the unwound portion of the conforce spring extends. The rib acts to engage cartridges in the magazine so that the unwound portion of the spring does not contact the cartridges. It was determined that such contact resulted in cartridge jamming problems in the magazine. The rib preferably contacts the cartridges between that part of the casing or body of the cartridges which, when contacted by the rib, tends to cause a cartridge nose up condition and the boundary between each of the casings and noses of the cartridge. Conversely, the rib should not contact the casing so as to cause a nose down condition. Preferably also, a second rib is formed on the inside surface of the side wall opposite that side wall having the rib for insuring that there is no contact between the unwound conforce spring portion and the cartridges. This second rib is preferably directly opposite the first rib, but need not be, and provides symmetry to the cartridges contained in the magazine. That is, with respect to the double column arrangement in the magazine, each cartridge of a first cartridge column and each cartridge of a second cartridge column are symmetrically located about a lateral axis extending between nose ends and bottom or rim ends of the cartridges so that possible cartridge jams that might occur, if such symmetry were not present, are avoided.

In another embodiment of the invention, instead of a conventional follower body, a newly devised follower body is provided, which is preferably characterized by a compound flat, cartridge-supporting surface. The flat or straight surface is contacted by two cartridges, instead of one cartridge as is the case with the conventional follower body. This follower body configuration prevents or reduces unwanted rotational movement of the follower body because two cartridges contact each other, as well as the follower body support surface. Such rotational movement can occur when a conforce spring is utilized. It is important that at least two angles defining the compound surface be within certain ranges so that the aforesaid contact by two cartridges is achieved. Specifically, a first angle defined utilizing a back edge of the supporting surface of the follower body should have a value between 5°–15° and a second angle defined using a side edge of the supporting surface should have a value between 20°–±°. If these two angles should be outside one or both of these two ranges, the necessary cartridge contact is not achieved.

The preferred embodiment also includes a number of differently configured and located latch areas so that the magazine can be used with a number of different commercially available firearms.

In view of this summary description of the present invention, a number of objectives thereof are readily seen. The conventional nine millimeter magazine having a compression spring has been replaced by a spirally wound conforce spring whereby more rounds or cartridges can be housed in a nine millimeter magazine in its fully loaded state. Because an essentially conventional-in-length nine millimeter magazine body is utilized, a workable location for the spring in the body had to be identified so that the cartridges could readily move between the top and bottom ends of the modified magazine. In a preferred embodiment, a rib is formed on the same side wall of the magazine along which the unwound portion of the conforce spring extends to prevent contact between the unwound conforce spring portion and the cartridges whereby jamming problems are avoided. In another embodiment of the invention, the conventional follower body is replaced by a follower body having a substantially straight, inclined surface whereby friction between the follower body and the walls of the magazine body is reduced because the use of such a follower body, as a contacting support for two cartridges, prevents or reduces unwanted rotation of the follower body. The invention can also provide sufficient spring force by using more than one conforce spring. Additionally, the magazine can be used with a plurality of firearms using the newly designed latch areas formed in the magazine walls.

Further advantages of the present invention will become readily apparent from the following discussion, when taken in conjunction with the accompanying drawings.

DETAILED DESCRIPTION OF THE EMBODIMENTS

Figure 1:
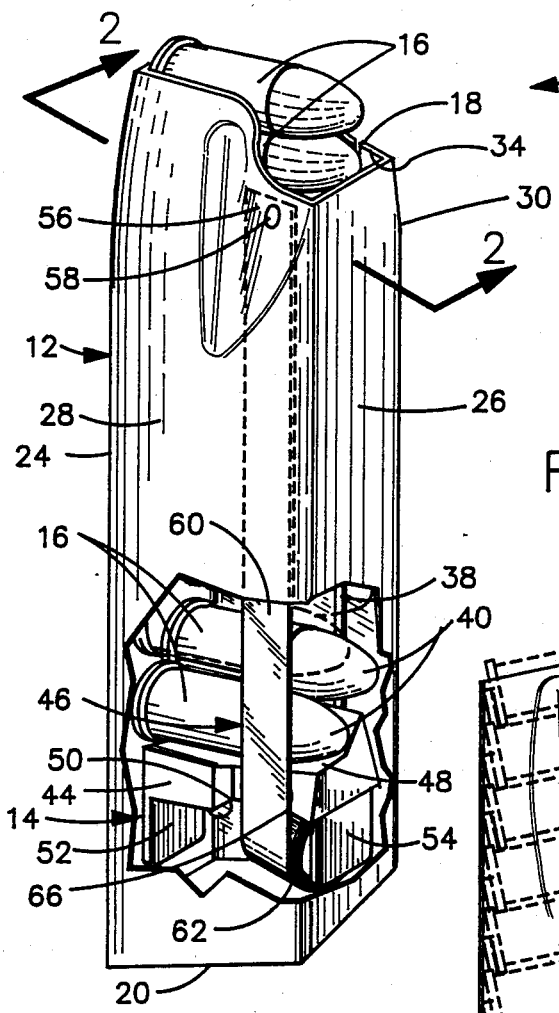
FIG. 1 is a perspective view of a nine millimeter magazine of the present invention with a bottom portion thereof cut away to illustrate the spirally wound conforce spring and its location relative to the magazine body and the follower body.
Figure 2:
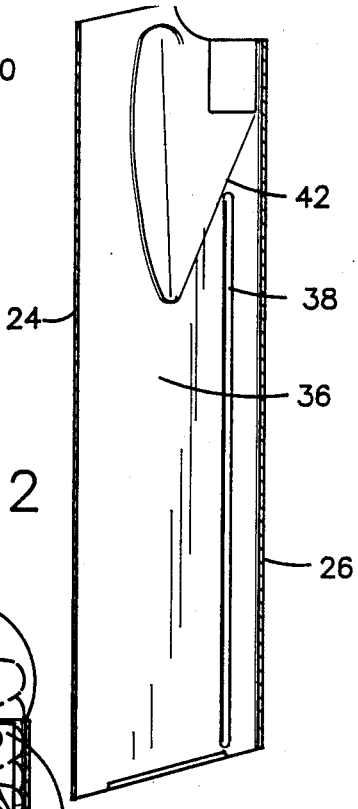
FIG. 2 is a cross-sectional view, taken along line 2—2 of FIG. 1, showing the rib located along the longitudinal extent of the inner surface of a side wall of the magazine.
Figure 3:
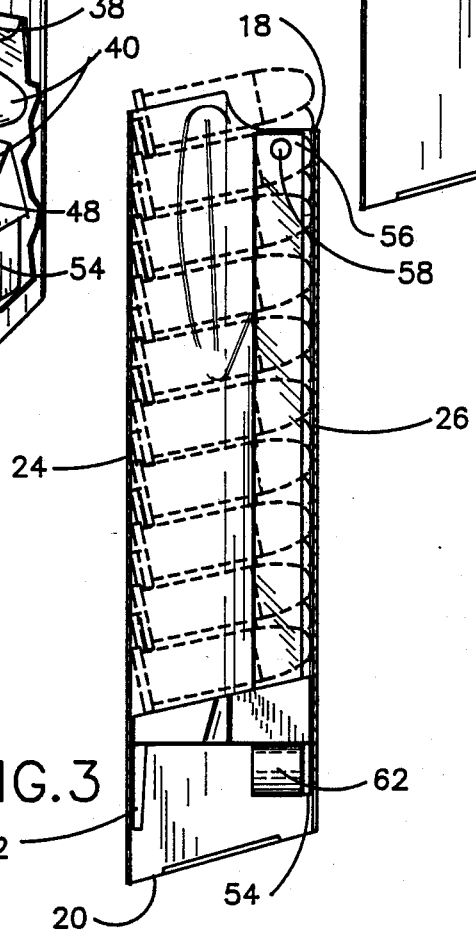
FIG. 3 is a sectional view with the cartridges shown in phantom lines and showing the unwound portion of the spring.

In accordance with the present invention, a magazine 10 is provided for housing nine millimeter cartridges. With reference to FIGS. 1–3, the magazine 10 includes a body 12 and a follower assembly 14. The magazine body 12 is used in housing nine millimeter cartridges 16 in a double column relationship. The follower assembly 14 is used in moving the cartridges in and out of the magazine body 12.

The body 12 of the magazine 10 has a top end 18 and a bottom end 20. In loading the cartridges 16 into the magazine body 12, the cartridges 16 move from the top end 18 towards the bottom end 20. When each cartridge 16 is to be ejected from the magazine 10 into the firearm, it is removed from the top end 18 of the magazine 10. In addition to the top and bottom ends or portions of the magazine 10, the magazine body 12 also includes a rear end wall 24, which is located on the left side of the magazine body 12, with reference to FIG. 3, and a front end wall 26, which is located on the right side of the magazine 10. The magazine body 12 is also defined by a first side wall 28 and a second side wall 30. The rear and front end walls 24, 26 and the first and second side walls 28, 30 define a chamber or storage space 34 for the cartridges 16.

The magazine body 12 described and illustrated herein has essentially the same length as the conventional magazine body for hosing nine millimeter cartridges including conventional magazine bodies used with the following identified firearms: Sig Sauer, Beretta and Taurus. However, unlike the conventional body, there is modification made to the inside surface 36 of the second side wall 30. In particular, the magazine 10 of the present invention includes a rib or protrusion 38 provided or formed on the inside surface 36 of the second side wall 30. The rib 38 is elongated and extends along the inside surface 36 from near the top 18 of the magazine body 12 to the bottom 20 thereof. In one embodiment, the length of the rib 38 is about 3.4 inches and it has different depths relative to the inside surface 36, i.e., it tapers wherein the depth of the rib 38 near the top portion 18 of the body 12 is about 0.025 inches while at the bottom portion 20 the depth is about 0.035 inches. The rib 38 is off-centered relative to a longitudinal, center line axis of the second side wall 30. Specifically, the rib 38 is positioned relatively more adjacent to the front end wall 26 than it is to the rear end wall 24. Stated in another way, the rib 38 is provided so that it is next to the nose ends 40 of the cartridges 16 when such cartridges 16 are loaded in the magazine 10. This location of the rib 38 relative to the noses 40 of the cartridges 16 is best seen in the cut away portion of FIG. 1. The purpose of the rib 38 will be explained later after the discussion of the follower assembly 14. In addition to the rib modification, the conventional transition zone illustrated at 42 (magazine part where the cartridges form a single column) may have to be lengthened somewhat over the conventional body to assure proper change from the double column to single column cartridge arrangement.

Figure 4:
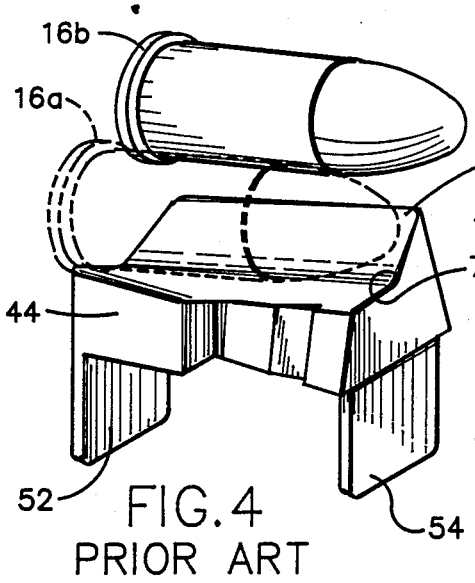
FIG. 4 PRIOR ART
FIG. 4 is a perspective view of a prior art follower body for use with a conventional nine millimeter magazine.

With reference to FIGS. 1, 3 and 4, the follower assembly 14 includes a follower body 44 and a follower spring unit 46, which is a spirally wound spring for use in providing uniform or constant force in moving cartridges 16 in the chamber 34 of the magazine body 12.

The follower body 44 of FIGS. 1–4 is of conventional configuration and includes a curved support surface 48, which contacts only one of the cartridges 16. The follower body 44 also has an under surface 50 which is located on the opposite side of the follower body 44. The follower body 44 also has a rear leg 52 and a front leg 54. The ear leg 52, when the follower body 44 is positioned in the chamber 34 of the magazine 10, is located adjacent to the rear end wall 24 while the front leg 54 is located adjacent to the front end wall 26.

The spirally wound spring unit 46 of the follower assembly 14 has a free end 56 which is attached to the inside surface of the first side wall 28 by means of a rivet or weld 58, or the like. The spring unit 46 includes an unwound segment or portion 60 and a wound segment or portion 62. As can be appreciated, as the cartridges 16 are loaded into the magazine 10, the length of the unwound portion 60 becomes greater and the amount of the wound portion 62 becomes less. As can be seen in FIGS. 1 and 3, the spring unit 46 is located in an off-centered position relative to the center, longitudinal axis of the first side wall 28. In particular, the unwound portion 60 of the spring unit 46 extends along the inside surface of the first side wall 28 adjacent to the front end wall 26. When cartridges 16 are loaded in the magazine 10, the unwound spring portion 60 is next to the nose ends 40 of the cartridges 16 and, in the usual situation, the unwound spring portion 60 and the nose ends 40, or the side wall near the nose ends, touch or contact each other. Like the wound portion 62, the unwound spring portion 60 of the spring unit 46 is located at the end or side of the follower body 44 which is adjacent to the front end wall 26. Parts of the wound spring portion 62 contact the lower surface 50 of the follower body 44 and parts thereof lie adjacent to the front leg 54 of the follower body 44.

The follower body 44 is quite comparable to a conventional or known follower body that has been used in a conventional magazine for housing nine millimeter cartridges; however, the conventional follower assembly 14 has been modified by the replacement of a conventional or commonly used compression spring with the spirally wound conforce spring unit 46 of the present invention. In connection with this modification, the desired positioning or location of the spirally wound spring unit 46 had to be identified. In particular, the spring unit 46 was located in a position that had sufficient space for the unwound spring portion 60 to occupy and not interfere with cartridge movement. In that regard, the free end 56 of the spring unit 46 was attached to the inside surface of the first side wall 28 adjacent to the reduced-in-diameter nose ends 40 of the cartridges 16. In addition, the conventional follower body was slightly modified to provide a sufficiently deep well 66 in a side wall of the follower body 44 so that the unwound spring portion 60 would have sufficient clearance between the inside surface of the first side wall 28 and the follower body 44.

With the incorporation of the conforce spring unit 46 in a conventional nine millimeter magazine, a greater number of cartridges or rounds can be housed in the magazine body 12. That is, in comparison with the conventional nine millimeter magazine having a compression spring, that present invention is able to house two more rounds than the conventional magazine. In one embodiment, for desired operation and use, the rib 38 was provided to prevent or reduce unwanted, slight movements of the cartridges 16 within the chamber 34. That is, in the absence of the rib 38, the cartridges 16 are able to move laterally relative to each other causing a somewhat rattling nose. The rib 38 is symmetrical with and located directly across from the unwound portion 60 of the spring unit 46. In the preferred embodiment, the depth or extent of the projection of the rib 38 from the inner surface 36 provides symmetry with the thickness of the unwound spring portion 60. The rib 38 also extends sufficiently to contact portions of the nose ends 40 while the unwound spring portion 60 contacts opposite portions of the nose ends 40. This arrangement permits the nose ends 40 to contact or ride along the unwound spring portion 60 and the rib 38 while preventing unwanted lateral movement of the cartridges 16 relative to each other.

In another embodiment of the nine millimeter magazine in which a spirally wound conforce spring unit is utilized, a newly configured follower body 74 is provided. With reference to FIGS. 5–10, as well as the prior art follower body 44 (except for the deeper well 66) best seen in FIG. 4, a detailed description of this new follower body embodiment is provided. The illustration of the prior art follower body depicted in FIG. 4 includes a representation of two nine millimeter cartridges 16*a*, 16*b*. The purpose of the depiction of the two cartridges 16*a*, 16*b* is to illustrate the position of these two cartridges 16 when they and the follower body 44 are located in the nine millimeter magazine 10. Specifically, as seen in FIG. 4, the follower body 44 has a support surface 48 on which the cartridge 16*a* is positioned. The support surface 48 is not flat or straight but is curved and essentially has a dip or shallow indent 70. The cartridge 16*a* essentially overlies the dip 70. The cartridge 16*b*, which is adjacent to the cartridge 16*a*, does not contact and is not directly supported by the curved support surface 48; rather, the cartridge 16*b* would be supported and held between the two side walls of the conventional magazine body. Because of this positioning of the two adjacent cartridges 16*a*, 16*b*, there is a tendency for the follower body 44 to rotate, when a conforce spring is utilized. That is, the leg 52 and/or the leg 54 have a tendency to contact the side wall 28 thereby creating friction and inhibiting free movement of the cartridges 16 and the follower body 44 and also changing the angle of the cartridges 16 in the magazine body 12.

Figure 5:
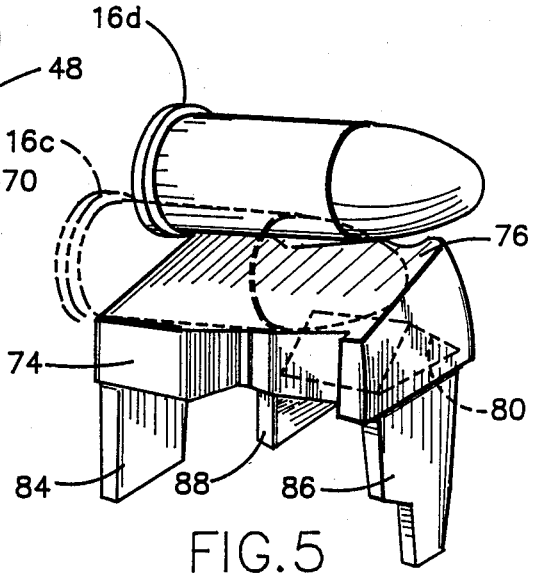
FIG. 5 is a perspective view of a follower body of the present invention for use in a nine millimeter magazine.

This unwanted result is corrected by the embodiment of the follower body 74 illustrated in FIGS. 5–10. As seen in these figures, the follower body 74 includes a straight or substantially flat support surface 76, instead of a curved support surface having a dip. The support surface 76 is preferably a compound flat and can be defined using the magnitude of the angles illustrated and identified in FIGS. 8–10. This configuration of a support surface 76 permits two cartridges 16*c*, 16*d* to both contact portions of the surface 76, as seen in FIG. 5. Because portions of both cartridges 16*c*, 16*d* contact portions of the support surface 76, as well as each other along their body or case portions, they act together to prevent or reduce the tendency of the follower body 74 to rotate. Although the flat surface contributes to the prevention of rotation, other embodiments of a follower body in which both of the two cartridges touch it and/or each other can be utilized to accomplish this objective.

Figure 6:
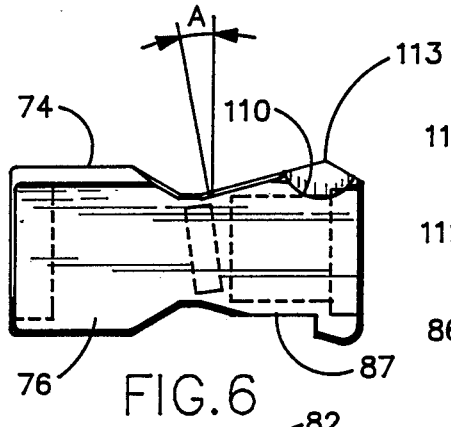
FIG. 6 is a to view of the follower body of FIG. 5.

In addition to the feature of preventing rotation using contact between adjacent cartridges 16 and a follower body 74, the follower body 74 also includes a nesting area or pocket 80 formed in the main portion of the follower body 74. The nesting area 80 receives at least parts of the wound portion of the conforce spring unit 82. This is a preferred arrangement of a follower body 74 because, in this configuration, the unwound portion of the spring unit 82 is held in place so that it will not engage the inner surface of either of the side walls of the magazine. Such engagement or contact would undesirably inhibit movement of the follower body 74. The pocket 80 is formed in the main portion of the follower body 74 between rear leg 84 and front leg 86, but it is off-center and located relatively more adjacent to the front leg 86. Although the pocket 80 is depicted as being triangular in shape, various shapes could be formed including a circular-shaped pocket. A sufficiently deep recess 87 is also formed in the side of the follower body 74 so that there is clearance between the follower body 74 and the unwound portion of the spring unit 82. As can be seen in FIG. 6, the recess 87 results in a deeper cut-out of material of the follower body 74 than is found in the adjacent portions of the follower body 74.

The follower body 74 also has a rib or projecting wall 88 that is provided adjacent to the pocket 80 and extends substantially downwardly relative to the support surface 76 and at an angle A, as seen in FIG. 6. It has been observed that, over periods of use of the magazine and spring unit, the diameter of the wound portion of the spring unit tends to increase. As a result of this increase, the wound portion tends to escape the pocket 80 and starts to rotate or twist. The projecting wall 88 acts to prevent unwanted rotation or twisting of the wound spring portion of the spring unit 82. If such rotating or twisting were allowed, spring portions could undesirably contact the magazine body and/or spring portions could engage one or more of the cartridges whereby the relatively free movement of the follower body and cartridges would be lessened. An angle of inclination of the wall 88, as illustrated in FIG. 6, is preferred to permit some turning movement of the spring unit 82 and avoid over controlling the wound portion. For example, the angle A could be about 5°, although other angles of inclination are possible.

Figure 10:
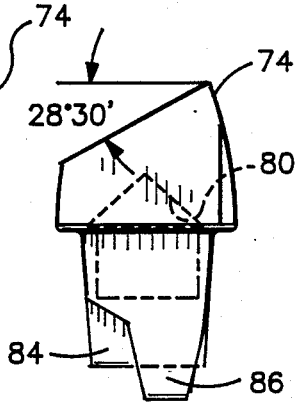
FIG. 10 is a front elevational view thereof.

The follower body 74 also differs from the follower body 44 in that the front leg 86 is longer than the rear leg 84, instead of being less in length like the follower body 44, and is also narrower at its bottom portions, as seen, for example, in FIG. 10. This configuration of font leg 86 including a desired length thereof is intended to satisfy a number of considerations. First, the length of the front leg 86 should be long enough so that the wound portion of the spring unit 82 is not deformed to an unwanted extent by engagement with the bottom surface of the magazine. Second, the length of the front leg 86 should be long enough to prevent the user from being able to load an unsuitable number of cartridges in the magazine. Third, the front leg 86 should be short enough to permit some downward movement of the cartridges when the slide of the firearm is in a closed state, so that the magazine can be latched. The tapering or narrowing of the bottom portion of the front leg 86 acts to prevent unwanted engagement between the wound portion of the spring unit 82 and the follower body 74. If such engagement occurred, it could happen that the wound portion would cause the follower body to rotate and undesirably engage a wall of the magazine body.

Figure 11:
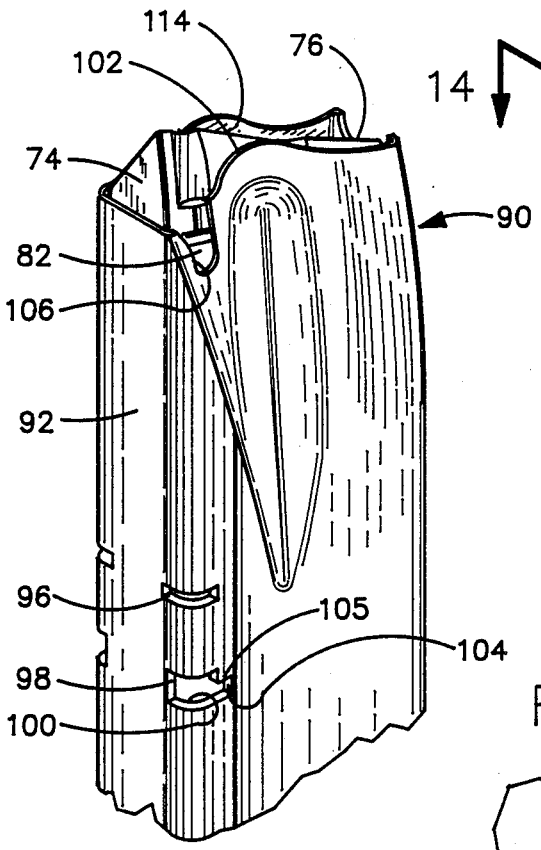
FIG. 11 is a perspective view of the top portions of a nine millimeter magazine of the present invention showing latch areas.
Figure 12:
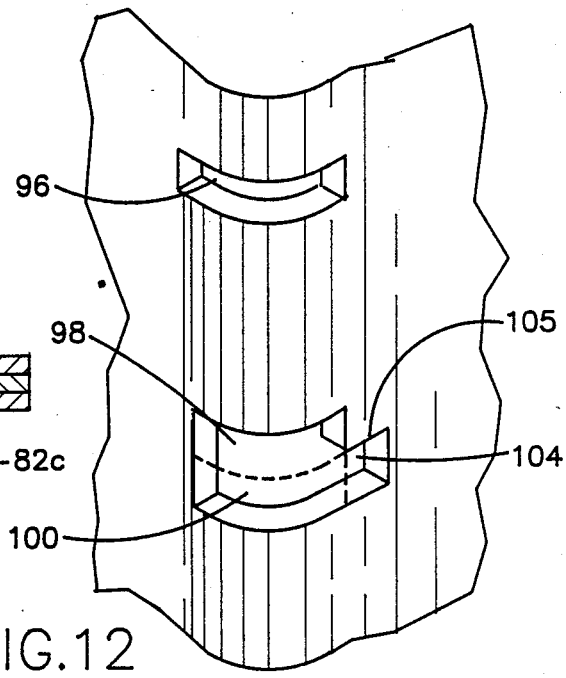
FIG. 12 is an enlarged, fragmentary view of the latch areas.

With reference to FIGS. 11 and 12, a further inventive feature is disclosed. Specifically, the magazine 90 includes a magazine body 92 having a number of latch areas 96, 98, 100 formed in portions of the walls of the magazine body 92. Each of these three latch areas 96, 98, 100 is utilized in receiving a latch mechanism of a particular firearm. The engagement between the latch of the firearm and one of the latch areas 96, 98, 100 is used in providing engagement or connection between the magazine 90 and the firearm.

The latch area 96 is used to receive the latch of a conventional Sig Sauer firearm. In contrast to the conventional latch area or hole provided in a conventional magazine to be used with a Sig Sauer firearm, the latch area 96 has a shorter dimension in the longitudinal direction of the magazine body 92 and, consequently, the total hole area of the latch area 96 is less than that found in the conventional magazine to be used with the Sig Sauer firearm. Additionally, with reference to the top edge 102 of the magazine body 92, the magnitude of the distance between the top edge 102 and the top of the latch area 96 is greater than the magnitude of this distance in the conventional magazine to be used with the Sig Sauer firearm.

With regard to the latch areas 98 and 100, these two areas overlap, i.e., portions of the latch area 98 can also be considered portions of the latch area 100 and vice versa. The latch area 98 is intended to receive a latch found on a conventional Taurus firearm. The latch opening of the conventional magazine to be used with a Taurus firearm can be considered identical in size and location to the latch area 98, which area includes all of the cut-out area, as best seen in FIG. 12 and identified by reference no. 98, except for the jog 104 or extended area of the cut-out. The jog area 104 is defined in FIG. 12 by the area between the phantom line (vertical direction) and the boundaries of the jog 104. The latch area 100 can be considered to include portions that overlap with the latch area 98. The area of overlap can be defined, with reference to FIG. 12, by the area bounded by the phantom lines (vertical and horizontal directions), by the lower edge of the latch area 98, and by the lower parts of the left side edge of the latch area 98. The latch area 100 also includes the jog area 104. The latch area 100 is used for receiving a latch of a Beretta firearm. The latch area 100, including the overlapping portions, can be considered identical in size and location to the latch opening found in the conventional magazine to be used with a Beretta firearm.

It was discovered that the latch in the Beretta firearm would actually engage the upper edge 105 of the jog area 104. Consequently, even though there is overlap between the two latch areas 98, 100, the latch of the Beretta firearm does not engage the upper edge of the latch area 98, but engages the upper edge of the jog area 104. In contrast to the present invention, the conventional magazine used with the Beretta and Taurus firearms does not include the combination of these two latch areas. Rather, each of these two conventional magazines includes only a single latch area for use with its respective firearm. Even though the latch areas 98, 100 can be considered to have the same size as the latch areas of the respective conventional magazines, no overlapping portions of the latch areas are found in each of the individual conventional magazines.

Figure 7:
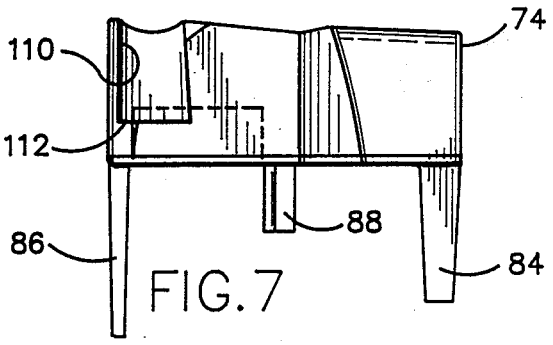
FIG. 7 is a left side elevational view thereof.
Figure 8:
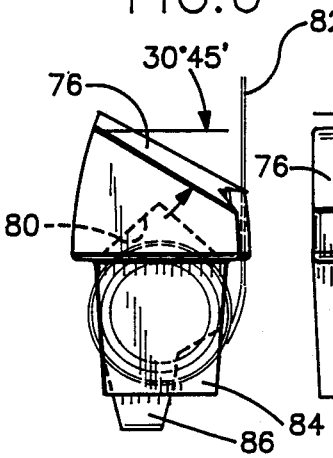
FIG. 8 is a rear elevational view thereof.
Figure 9:
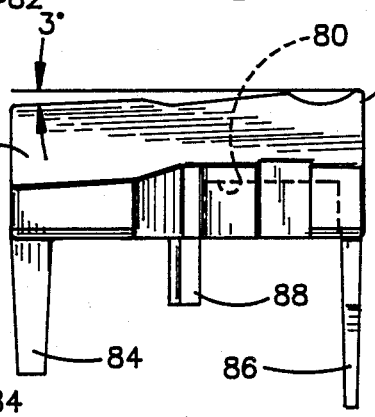
FIG. 9 is a right side elevational view thereof.

In connection with creating and developing three different latch areas with each of the three latch areas intended to be used with a different firearm, it was necessary also to modify or compromise certain other aspects of the magazine body and the follower body so that the magazine of the present invention would properly function in all three firearms. In particular, with reference to FIGS. 7 and 11, the depth of the well 106 formed in the top portion of the magazine body 92 was modified, in comparison with conventional magazines for use with the above-discussed three firearms. Additionally, an accommodation was made in the length of a channel 110 and the resulting position of a shelf 112 formed in a side of the follower body 74, as illustrated in FIG. 7. In a preferred configuration, the follower body 74 illustrated in FIGS. 5–10 is utilized in the magazine body 92 having the latch areas 96, 98, 100. The channel 110 and the shelf 112 are used in connection with the engagement of the conventional slide hold open mechanism found on each of the three firearms. The slide hold open mechanism is used to indicate to the user that all rounds initially contained in the magazine have been fired. That is, the slide hold open mechanism enables the user to see that there are no more rounds left in the firearm chamber or magazine. In operation, a part of the slide hold open mechanism of the firearm moves along the channel 110 of the follower body 74 as the follower body 74 moves upwardly as it completes its travel towards the top portion of the magazine body 92. Eventually the shelf 112 engages the slide hold open mechanism of the firearm and, during continued movement upwardly of the follower body 74, causes it to move whereby the slide hold open mechanism is activated to expose the chamber of the firearm. Because of the relationship between the slide hold open mechanism and latch mechanism of the firearm, the position of the shelf relative to the follower body 92 must be taken into account together with the locations and sizes of the latch areas 96, 98, 100 in order to provide a working magazine for each of the three aforesaid firearms.

In addition to the determination of the location of the shelf 112 and the depth of the well 106, it was also necessary to determine a workable shape of the top part of the follower body 74 including the support surface 76 so that a proper angle was formed between the cartridges 16 and the follower body 74, which supported the cartridges 16. In making these compromises or accommodations among the various parts of the magazine, the angle that the cartridge 16 made with the follower body 74 was different from that found in the conventional magazine used in the Sig Sauer firearm, for example, which includes a conventional follower. That is, that angle that a cartridge 16 makes with the support surface 76 is relatively less than the angle defined by a cartridge and a support surface of a follower of a conventional magazine used in the Sig Sauer firearm.

Another modification made to conventional follower bodies relates to the magnitude of the outward extent of the shelf 112. In contrast to conventional follower bodies used with Beretta and Sig Sauer firearms, the tip 113 of the shelf 112, as seen in FIG. 6, extends about 1/16 of an inch further out. If this were not incorporated in the present invention, proper opening of the slide mechanism could not be achieved when the magazine 90 is used in the Taurus firearm.

Figure 13:
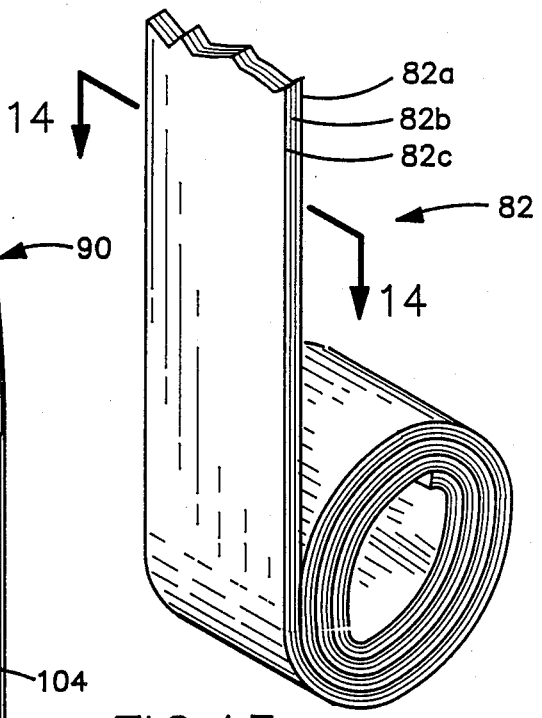
FIG. 13 is a fragmentary view of the magazine of FIG. 11 showing the three conforce springs.
Figure 14:
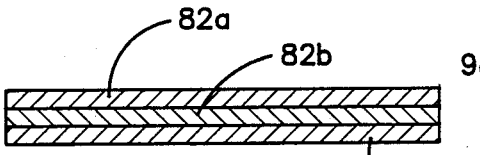
FIG. 14 is a cross-sectional view, taken along line 14—14 of FIG. 13, showing the three springs.

A further important feature of the present invention is also illustrated in FIGS. 13 and 14. In a preferred embodiment, the spring unit 82 is not a single, integral member. Instead, the spring unit 82 includes a number of conforce springs that cooperate in providing the necessary force for cartridge and follower movement. In the embodiment shown, the spring unit 82 includes three separate conforce springs **82*a*, 82*b*, 82*c*. Like the embodiment of FIG. 1, the three conforce springs 82*a*–82*c* are in contacting engagement with each other and are attached to the side wall 114 of the magazine body 92 adjacent to the top portion thereof. Like the single spring embodiment, each of the three conforce springs 82*a*–82*c* extends along the longitudinal extent of the side wall 114 when cartridges are located in the magazine 90. Also like the single spring embodiment, each of the three springs can be wound or coiled to provide a wound portion of the three springs. In devising the present invention in which a conforce spring unit is being used, it was determined that separate conforce springs were needed to provide the desired spring force. That is, such a spring force could not be achieved and, at the same time, avoidance of unwanted contact between the magazine body 92 and the spring unit 82, unless more than one conforce spring is used. Widening of the single conforce spring to achieve more spring force would result in unwanted contact between the unwound spring portion and the font end wall of the magazine body and/or the casing of one or more of the cartridges. Alternatively, a thicker spring intended to provide more spring force would result in a larger diameter thereby creating unwanted contact between the wound spring portion and a side wall of the magazine. Also, the use of a plurality of conforce springs avoids the possibility of an over-stressed single conforce spring. The projecting wall 88 of the follower body 74 also provides another function when it is used with the multi-layered spring unit 82. Specifically, the wall 80 acts to prevent relative lateral movement among the individual conforce springs 82*a*–82*c*. Consequently, the springs 82*a*–82*c*** do not separate from each other in a lateral direction.

It should be appreciated from the foregoing that, although the follower embodiment of FIGS. 5–10 may be utilized with a nine millimeter magazine having a rib 38, the use of such a rib may not be necessary. It should also be appreciated that, although it is preferred that the latch areas disclosed herein be used with the other features of the present invention, such latch areas could be provided without such other features in, for example, a magazine that utilizes a compression spring. It should also be understood that, although the illustrated embodiment discloses the use of three separate conforce springs, two separate conforce springs or four or more conforce springs might be utilized to achieve the same desired spring force for moving cartridges and the follower. It should also be understood that features of the present invention could be incorporated in a magazine that houses only a single column of cartridges.

Figure 15:
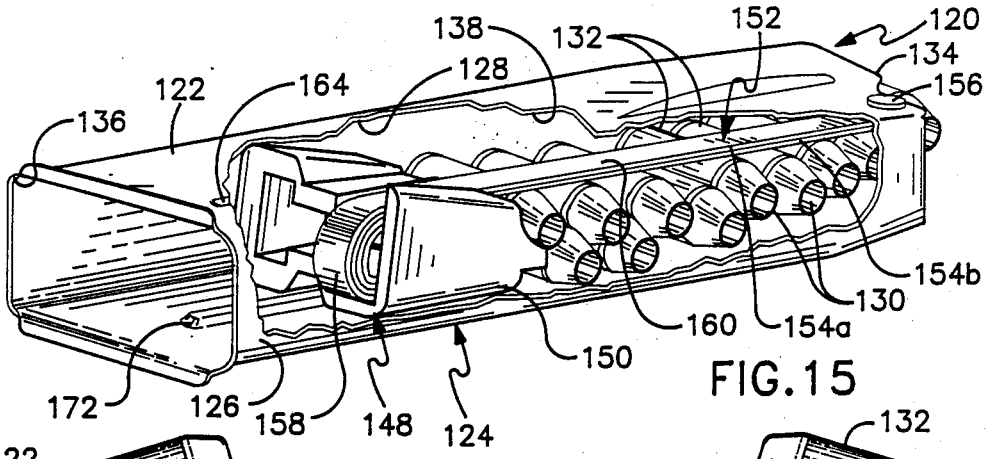
FIG. 15 is a perspective view of a preferred embodiment of a nine millimeter magazine of the present invention with portions cut away to illustrate the double layer conforce spring and the use of a rib on each of the two side walls with one of the ribs for use in maintaining a space between the conforce spring and the cartridges.

A more preferred embodiment of the invention is illustrated in FIGS. 15–31. A perspective view of this embodiment is shown in FIG. 15. Like the other embodiments, the magazine 120 of FIG. 15 includes a first side wall 122, a second side wall 124, and end walls 126, 128 with the first end wall 126 located adjacent to the nose ends 130 of the cartridges 132, while the second end wall 128 is located adjacent to the opposite ends of the cartridges 132. The magazine 120 also includes a top opened end or portion 134 and a bottom end or portion 136. The cartridges 132 are preferably nine millimeter cartridges housed in the chamber 138 of the magazine 120. The chamber 138 can be defined as including a major section in which the nine millimeter cartridges 132 are in a double column arrangement and a transition section in which the double column arrangement of cartridges 132 becomes a single column so that each cartridge enters and exits the magazine 120 as part of a single column. The transition section is characterized by the formation of elliptical-shaped, compressed areas 144, 146. The compressed area 144 is formed near the top portion 134 of the magazine 120 on the side wall 122 while the compressed area 146 is formed near the top portion 134 on the side wall 124. The compressed areas 144, 146 act to cause the double column of cartridges 132 to become a single column.

This embodiment also includes a follower assembly 148 comprising a follower body 150 and a conforce spring unit 152. Details of the follower body 150 are best seen in FIGS. 25–31 and will be subsequently discussed herein. The conforce spring unit 152 includes a pair of conforce springs 154*a*, 154*b*. The use of the double layer conforce spring unit 152 is advantageous for the reasons already expressed in connection with FIGS. 13 and 14. The conforce springs 154*a*, 154*b* are wound together and are separated but aligned so that their longitudinal extents are contiguously adjacent with the conforce spring 154*a* overlying the conforce spring 154*b* and being more adjacent to the inside surface of the side wall 122. The free ends of the conforce springs 154*a*, 154*b* are connected to the side wall 122 at the top portion 134 of the magazine 120 using a rivet 156 or the like.

Similar to previous embodiments, the conforce spring unit 152 can be defined as including a wound portion 158 and an unwound portion 160. The wound portion 158 is held by the follower body 150 while the unwound portion 160 extends in the chamber 138 along the inside surface of the side wall 122 and near the first end wall 126.

Figure 16:
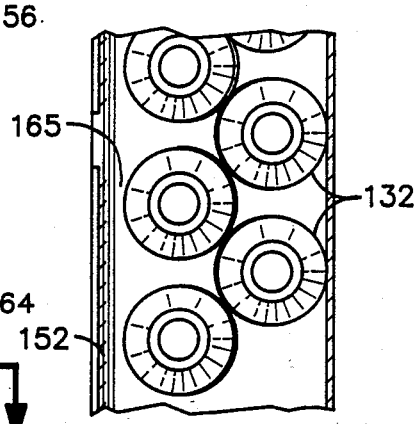
FIG. 16 is an enlarged, fragmentary end view of the magazine embodiment of FIG. 15 illustrating the space or gap between the conforce spring unit and the cartridges in the double column arrangement of cartridges.

An important feature emphasized in this embodiment is the prevention of contact between the conforce spring unit 152 and the cartridges 132. In that regard, while the cartridges 132 are found in the double column arrangement, a rib 164 acts to prevent contact between the conforce spring unit 152, particularly the conforce spring 154*b*, and the cartridges 132. The rib 164 is formed on the side wall 122 and extends for a predetermined or desired depth from the inside surface of the side wall 122 into the chamber 138. The rib 164 contacts desired portions of the cartridges 132 so that a space or gap 165 is always maintained between the exposed surface of the conforce spring 154*b* and the cartridges 132, as illustrated in FIG. 16, as well as FIGS. 19–20. Maintaining the absence of contact between the conforce spring unit 152 and the cartridges 132 provides smooth and desirable movement of the cartridges 132 in the chamber 138 and reduces cartridge jamming problems that might occur during such cartridge movements.

Figure 17:
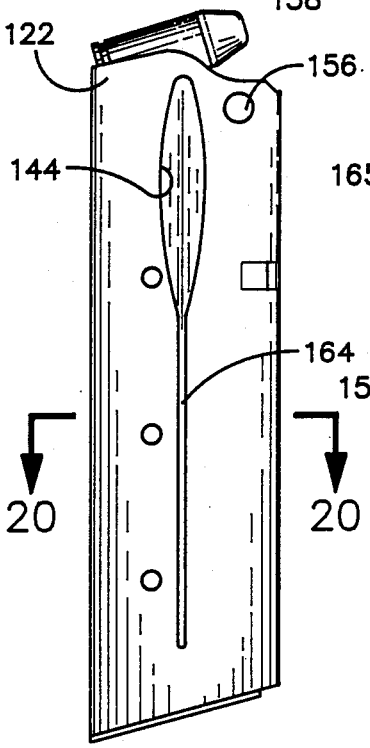
FIG. 17 is a side view illustrating a first side wall of the magazine of FIG. 15 to which the conforce spring is attached.
Figure 20:
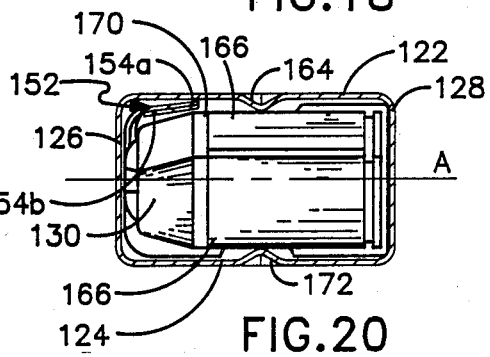
FIG. 20 is a cross-sectional view, taken along line 20—20 of FIG. 17, illustrating the ribs contacting the casings of the cartridges.
Figure 21:
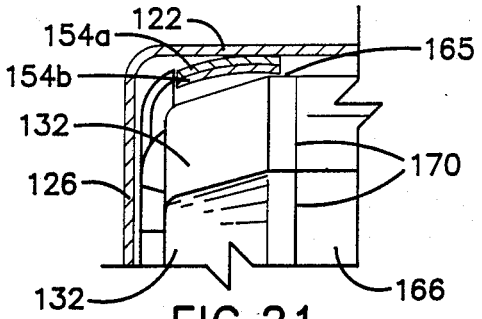
FIG. 21 is an enlarged, fragmentary cross-sectional view similar to FIG. 20 but illustrating the bent or turned-up longitudinal edges of each of the conforce springs.

With reference to FIGS. 17 and 20, the rib 164 is preferably located along the side wall 122 such that it contacts the body or casing 166 of the cartridges 132. The contact is made so that the rib 164 tends to push the nose ends 130 away from the conforce spring unit 152 in order to provide or maintain the space 165 between the conforce spring unit 152 and the cartridges 132. Consequently, the rib 164 must contact the casings 166 at an area or point that tends to cause this desired positioning of the nose ends 130 away from the conforce spring unit 152 rather than tipping or causing the nose ends 130 to be moved towards the conforce spring unit 152. It is also preferred that the rib 164 be formed so that it does not contact parts of the boundary or ring 170 located between each of the nose ends 130 and the casings 166 of the cartridges 132. Because the boundaries 170 are essentially discontinuous and result in unsmooth surfaces, it is preferred that the rib 164 not contact the boundaries 170 to prevent possible interference or unwanted engagement between the rib 164 and the cartridges 132 during their movement in the chamber 138.

With reference to FIG. 32, in connection with achieving the desired space 165, the bending or turned-up edges of the conforce springs 154*a*, 154*b* must be taken into account. The conforce springs 154*a*, 154*b* are not completely flat when unwound; rather their longitudinal edges are bent slightly towards the cartridges 132. To ensure that the desired space 165 is maintained so that the bent edges do not contact cartridge(s) 132, this physical phenomenon associated with the unwound portions of the conforce springs 154*a*, 154*b* is considered when designing the magazine 120 including the depth of the rib 164.

Figure 18:
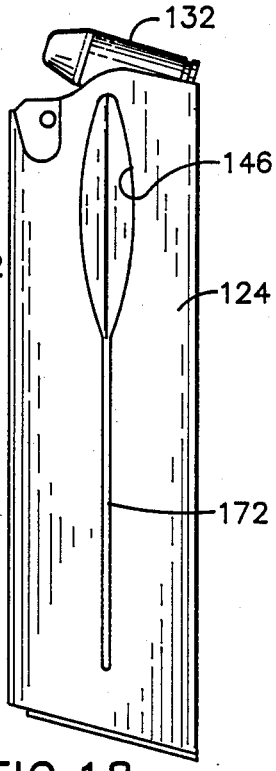
FIG. 18 is a side view illustrating the opposing second side wall.
Figure 19:
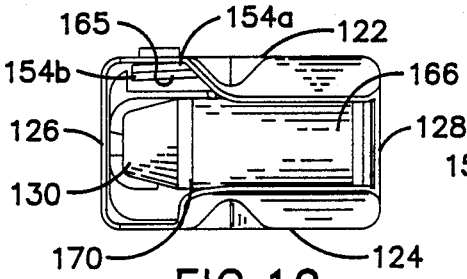
FIG. 19 is a top view of the magazine of FIG. 15.

With reference to FIG. 18 also, the preferred embodiment includes a second rib 172 formed on the second side wall 124. The second rib 172 acts to reduce possible cartridge jamming problems by providing symmetry for the first and second columns of cartridges 132 housed in the major section of the magazine 120. Specifically, each of the cartridges 132 in a first column is maintained at essentially the same distance from a lateral axis A extending between the end walls 126, 128 of the magazine 120, as a corresponding cartridge 132 of the second column of cartridges. As seen in FIGS. 18 and 20, the rib 172 is formed along the center, longitudinal extent of the side wall 124 and terminates at the compressed area 146. Consequently, in the embodiment shown, the rib 172 is essentially directly opposite the first rib 164, as best seen in FIG. 20, although it need not be directly opposite but may be located offset from the rib 164 so long as the desired symmetry of cartridges is maintained.

In connection with determining the depth or extent of the rib 164 into the chamber 138, together with its location along the side wall 122, and between the first and second end walls 126, 128, certain factors are taken into account. Generally, it has been found that the depth of the rib 164 relates to or is a function of its contacting position on the casings 166 of the cartridges 132, as well as the positioning of the conforce spring unit 152 relative to the first end wall 126 and the thickness of the conforce spring unit 152. Such inter-relationships are intended to be illustrated by different embodiments shown in FIGS. 22–24.

Figure 22:
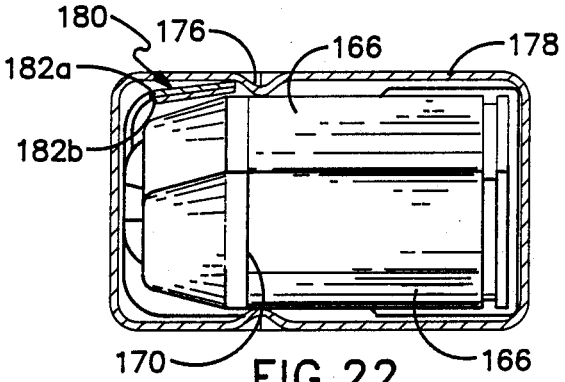
FIG. 22 illustrates another embodiment in which the ribs are located to contact the cartridge casings more adjacent to the boundary between the casings and the noses of the cartridges.

FIG. 22 represents an embodiment in which a rib 176 is located, not essentially along the center of the longitudinal extent of a side wall 178, but is offset and contacts the casings 166 near the boundaries 170. In this embodiment, the depth of the rib 176 need not be as great as the depth of the rib 164 in order to provide the necessary gap between the nose ends 130 and the conforce spring unit 180, which includes the double layer conforce springs 182*a*, 182*b*. That is, because the rib 176 is located closer to the nose ends 130 and correspondingly closer to the conforce spring unit 180, it requires a lesser depth into the magazine chamber to bring about the necessary separation of the nose ends 130 from the conforce spring unit 180.

Figure 23:
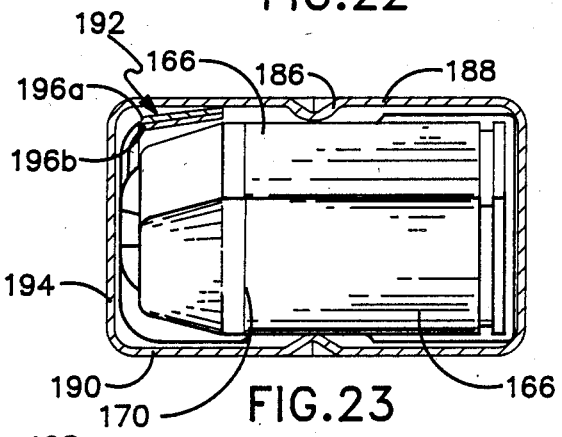
FIG. 23 is still another embodiment illustrating the ribs at essentially the same location as the ribs of FIG. 20 but with the ribs having less depth into the chamber of the magazine.

Another embodiment illustrative of the relationship involving the depth of the rib formed on the side wall is shown in FIG. 23. A rib 186 extends into the magazine chamber from the inside surface of the side wall 188 about the same distance or depth as the rib 176 illustrated in FIG. 22; however, instead of being located to contact the casings 166 adjacent to the boundaries 170, the rib 186 is located substantially at the same position as the rib 164 in the embodiment of FIG. 20. Consequently, the casings 166 in the double column arrangement are located slightly closer to the side walls 188, 190. In this embodiment, to avoid contact between a conforce spring unit 192 and the cartridge noses 130, the spring unit 192 is positioned relatively closer to the first end wall 194 so that the conforce spring unit 192, including the separate but contiguously adjacent conforce springs 196*a*, 196*b*, is located relatively more adjacent the tapering portions of the nose ends 130 than the embodiment of FIG. 20. In such a position, there is more space for the conforce spring unit 192 and the cartridges 132 require less depth from the rib 186 to provide the desired gap. Consequently, placement of the conforce spring unit 192 has influenced the depth needed for the rib 186, when the rib 186 is located along about the center longitudinal axis of the side wall 188.

Figure 24:
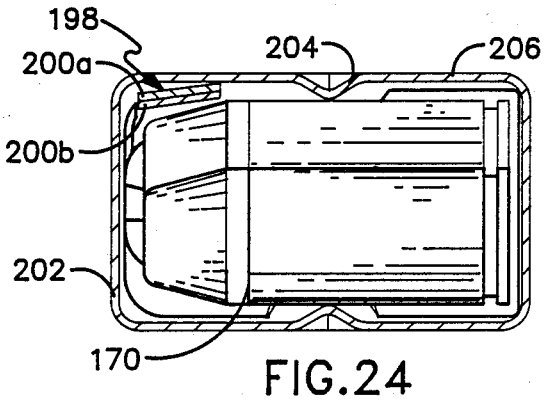
FIG. 24 illustrates still yet another embodiment in which the ribs are formed essentially the same as in the embodiment of FIG. 20, but the thickness of the two contiguous conforce springs is increased over the embodiment of FIG. 20 and the conforce springs are located more closely to the end wall of the magazine.
Figure 25:
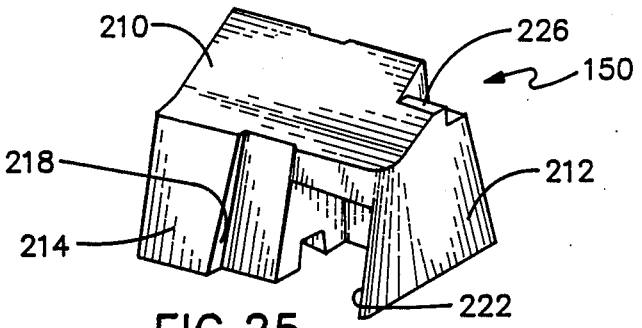
FIG. 25 is a perspective view of the follower body of the embodiment of FIG. 15.
Figure 26:
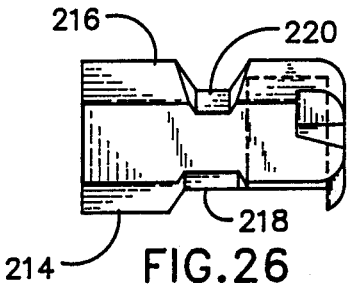
FIG. 26 is a top view of the follower body of FIG. 25.

A further embodiment illustrating the relationship among the conforce spring unit, including its thickness and location and the side wall rib including its depth and location, is depicted in FIG. 24. In this embodiment, the conforce spring unit 198 has an increased thickness relative to the conforce spring unit 152 of FIG. 20. The conforce spring unit 198 is a double layer unit comprised of conforce springs 200*a*, 200*b* and is located more adjacent to a first end wall 202 than is the conforce spring unit 152 of the embodiment of FIGS. 19–20. As with the other embodiments, a rib 204 is formed on the inside surface of a side wall 206 and extends into the magazine chamber for a depth sufficient to contact the casings 166 of the cartridges 132. The rib 204 is formed at essentially the same position as the rib 164 of the embodiment illustrated in FIG. 20. However, even though the conforce spring unit 198 is thicker, because of its position more adjacent to the first end wall 202, which provides more space to receive the conforce spring unit 198, the depth of the rib 204 need only be about the same depth as the rib 164. Again, the functional relationship between the conforce spring unit 198 and the side wall rib 204 permits some change relative to each other while still maintaining the necessary gap between the conforce spring unit 198 and the cartridges 132.

Figure 27:
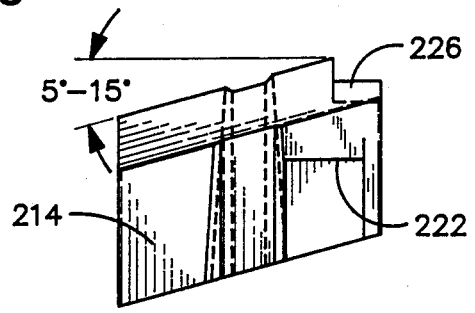
FIG. 27 is a right side elevational view thereof.

The follower body 150 of this preferred embodiment is illustrated in FIGS. 25–31. The follower body 150 is similar in many respects to the follower body disclosed in FIGS. 5–10, with the important feature being the determination of ranges associated with the values of certain angles utilized in defining the compound support surface of the follower body 150. In particular, the surface which contacts two of the cartridges 132 is a compound surface 210. A first angle used in defining the compound surface 210 is best illustrated in FIG. 27 and is defined using the back edge of the support surface 210 and a horizontal line projecting from the top part of the back edge. It has been determined that this first angle should have a value of 5°–15° in order that the support surface 210 contact two of the cartridges 132. If the angle formed is outside of this range, the desired contact would not be achieved and there would be a tendency for the follower body 150 to rotate leading to cartridge jamming problems.

Figure 28:
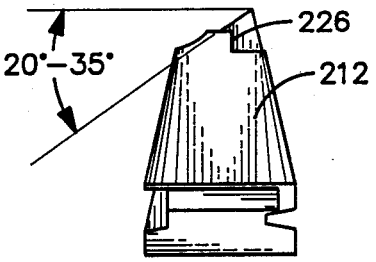
FIG. 28 is a front elevational view thereof.
Figure 29:
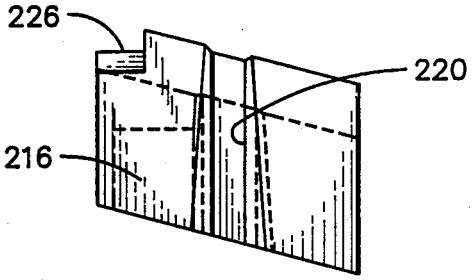
FIG. 29 is a left side elevational view thereof.
Figure 30:
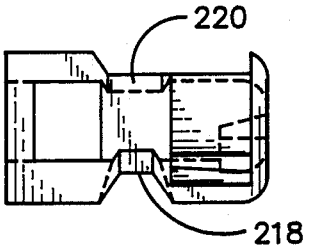
FIG. 30 is a bottom view thereof.
Figure 31:
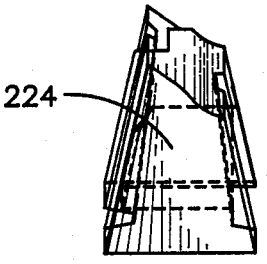
FIG. 31 is a rear elevational view thereof.

A second angle relating to the formation of the compound support surface 210 is best depicted in FIG. 28. This second angle is defined using a side edge of the support surface 210, which is adjacent to a front end wall 212 and a horizontal line also drawn from the top part of the back edge of the support surface 210. It has been determined that this second angle should have a magnitude in the range of about 20°–±° in order to insure contact by the support surface 210 of two of the cartridges 132. If not, as with the previously discussed first angle, contact between the support surface 210 and the desired two cartridges 132 would not be achieved, leading to expected cartridge jamming problems.

With regard to other aspects of the follower body 150, it includes a side wall 214 and a side wall 216, with each of the walls 214, 216 having channels 218, 220, respectively, formed in about the mid-portions thereof. The channel 218 is a recessed area and provides a space such that the side wall rib 164 does not contact the follower body 150. Similarly, the channel 220 is a recessed area and provides a space so that the side wall rib 172 does not contact the follower body 150. Like the previous embodiment, the follower body 150 has a nesting area 222 for housing the unwound portion of a conforce spring unit. The nesting area 222 is formed in the side wall 214 adjacent to that portion of the follower body 150, which will support the nose ends 130 of the cartridges 132. In addition to the end wall 212, the follower body 150 also has a second end wall 224, with each of the two end walls 212, 224 diverging or flaring outward to provide greater stability against the end walls of the magazine and thereby further reduce the possibility of follower body rotation in the magazine. The follower body 150 also has a bolt hold-open area 226 formed at the top of the end wall 212, which is used to hold open the bolt mechanism on the firearm once the last cartridge in the magazine has been fired.

Based on the foregoing description, a number of advantages of the present invention are immediately recognized. A magazine is provided for housing two more cartridges or rounds than can be housed in a conventional magazine having substantially the same body dimensions as found in the present invention. A spirally wound conforce spring is used as part of the follower assembly, instead of a conventionally used compression spring. The conforce spring is positioned at a desired location within the magazine body whereby the dimensions of the magazine body remain substantially the same as the conventional body. A rib is provided to prevent contact between the conforce spring and the cartridges to reduce possible cartridge jamming. In another embodiment, unwanted movements of cartridges resulting in undesirable rattling or other noise is prevented or reduced by means of a rib. A nesting area is formed in the main portion of a preferred follower body to prevent unwanted movement of the unwound portion of the conforce spring whereby it can contact a side wall of the magazine body and thereby inhibit free movement of the follower body. A projecting wall is also provided on the follower body to maintain a desired width of unwound spring portion and prevent contact thereof with the magazine body. To ensure sufficient spring force and avoid unwanted spring contact with the magazine body, individual conforce springs are utilized. Finally, a number of different latch areas are formed in the magazine body so that the magazine of the present invention can be used with more than one known or conventional firearm.

The foregoing discussions of the inventions have been presented for purposes of illustration and description. They are not intended to be exhaustive or to limit the invention to the precise forms disclosed, and other modifications and variations may be possible in light of the above teachings. The embodiments were chosen and described in order to best explain the principles of the invention and their practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A magazine for housing cartridges, comprising: a magazine body including a top portion, a bottom portion, first and second end walls, first and second side walls, each of said first and second side walls having a greater width than each of said first and second end walls, said first and second end walls and side walls defining a magazine chamber for storing cartridges, said magazine body housing a double column arrangement of cartridges and including a transition portion located adjacent to said top portion of said magazine body wherein the cartridges move from a double column arrangement to a single column arrangement;

a follower assembly including a follower body and spirally wound conforce spring means, said follower body including a nesting area located near a front end portion of said follower body, and said conforce spring means including a free end connected to said first side wall and, when said magazine body contains cartridges, said conforce spring means includes an unwound portion and a wound portion, said unwound portion of said conforce spring means extending along said first side wall adjacent to nose ends of the cartridges and at least a part of said wound portion of said conforce spring means being received in said nesting area, which is adjacent to the nose ends of the cartridges, wherein said conforce spring means includes at least a first conforce spring and a second conforce spring separate from said first conforce spring, said second conforce spring overlying and contacting substantial portions of said first conforce spring wherein increased spring force is provided along substantially the same longitudinal extent of said first side wall using said first and second conforce springs.

2. A magazine, as claimed in claim 1, wherein:

said follower body includes a support surface, said support surface being defined using said front end portion of said follower body and a rear end portion of said follower body, said rear end portion being located adjacent to ends of cartridges opposite the nose ends thereof, wherein a first angle is defined near the top of said support surface in a downwardly direction from said front end portion to said rear end portion, and wherein said follower body also includes a first side wall and a second side wall with a second angle being defined in a direction from said second side wall to said first side wall, said second angle being greater than said first angle and said first and second angles being used to define a compound support surface for said follower body with said compound support surface being contacted by two cartridges in order to reduce unwanted movement of at least one of said follower body and the cartridges contained in said magazine body adjacent to said follower body.

3. A magazine, as claimed in claim 1, further including:

a rib located on said second side wall and extending along the longitudinal extent of said magazine body.

4. A magazine, as claimed in claim 3, wherein:

said rib is located on said second side wall directly opposite said unwound portion of said spring means.

5. A magazine, as claimed in claim 1, wherein:

said follower body includes a nesting area formed therein for receiving at least part of said unwound portion of said spring means to prevent contact between said unwound portion and a part of the magazine.

6. A magazine, as claimed in claim 1, wherein:

the cartridges contained in the magazine include nine millimeter cartridges.

7. An apparatus, as claimed in claim 1, further including:

a plurality of latch areas formed in at least one of said walls of said magazine body, at least two of said latch areas being used by two different styles of firearms in connection with providing proper engagement between said magazine body and such firearms.

8. A magazine, as claimed in claim 1, wherein said follower body includes a projecting wall extending downwardly for use in engaging said unwound portion of said spring means to prevent an undesired increase in width thereof.

9. A magazine, as claimed in claim 1, wherein:

said follower body includes a rear leg and a front leg, said front leg being relatively more adjacent to the nose end of each cartridge than is said rear leg, said front leg having a greater length than said rear leg.

10. A magazine, as claimed in claim 9, wherein:

said front leg includes bottom portions narrower than top portions of said front leg.

11. A magazine for housing cartridges with each cartridge being definable as having a casing, a nose end and a boundary between the casing and the nose end, said magazine comprising:

a magazine body including a top portion, a bottom portion, front and rear end walls, first and second side walls, each of said first and second side walls having a greater width than each of said front and rear end walls, said front and rear end walls and side walls defining a magazine chamber for storing cartridges;

a follower assembly including a follower body and spirally wound conforce spring means, said conforce spring means including a free end connected to said first side wall and, when said magazine body contains cartridges, said conforce spring means including an unwound portion and a wound portion, said unwound portion of said conforce spring means lying in a plane substantially parallel to said width of said first side wall and extending along said first side wall adjacent to but spaced form nose ends of the cartridges so that said unwound portion does not touch the cartridges and said wound portion of said conforce spring means being located near a front wall of said follower body, which is adjacent to the nose ends of the cartridges; and first rib means provided on said first side wall for engaging parts of the cartridges, said first rib means having a depth into said magazine chamber for use in providing said space between said unwound portion of said conforce spring means and the cartridges and wherein, when cartridges are housed in the magazine, a majority of said unwound portion of said conforce spring means is closer to said front end wall than the boundary of each cartridge and the cartridge boundary is between said majority of said unwound portion and said first rib means wherein said conforce spring means does not contact the cartridge nose ends and the cartridges are substantially maintained in a nose up condition.

12. A magazine, as claimed in claim 11, wherein:

said depth of said first rib means depends upon the position of said first rib means relative to the nose ends of the cartridges, the thickness of said conforce spring means and the position of said conforce spring means relative to said front wall.

13. A magazine, as claimed in claim 11, further including:

second rib means located on said second side wall and extending in a longitudinal direction, said second rib means having a depth wherein at least two cartridges are symmetrical about an axis perpendicular to and extending between said front and rear end walls of said magazine.

14. A magazine, as claimed in claim 11, wherein:

said follower body comprising a compound support surface including said front wall, said front wall diverging outwardly as said front wall extends downwardly perpendicular from said compound support surface.

15. A magazine for housing cartridges, comprising:

a magazine body including a top portion, a bottom portion, front and rear end walls, first and second side walls, each of said first and second side walls having a greater width than each of said front and rear end walls, said front and rear end walls and side walls defining a magazine chamber for storing cartridges;

a follower assembly including a follower body and spirally wound conforce spring means, said conforce spring means including a free end connected to said first side wall and, when said magazine body contains cartridges, said conforce spring means including an unwound portion and a wound portion, said unwound portion of said conforce spring means extending along said first side wall adjacent to but spaced from nose ends of the cartridges so that said unwound portion does not touch the cartridges and said wound portion of said conforce spring means being located near a front wall of said follower body, which is adjacent to the nose ends of the cartridges; and first rib means provided on said first side wall for engaging parts of the cartridges, said first rib having a depth into said magazine chamber for use in providing said space between unwound portion of said conforce spring means and the cartridges, said first rib means being positionable laterally along said first side wall wherein the depth of said first rib means into said magazine chamber decreases the closer said first rib means is positioned to said front end wall near the nose ends of the cartridges.

16. A magazine for housing cartridges, comprising:

a magazine body including a top portion, a bottom portion, front and rear end walls, first and second side walls, each of said first and second side walls having a greater width than each of said front and rear end walls, said front and rear end walls and side walls defining a magazine chamber for storing cartridges;

a follower assembly including a follower body and spirally wound conforce spring means, said conforce spring means including a free end connected to said first side wall and, when said magazine body contains cartridges, said conforce spring means including an unwound portion and a wound portion, said unwound portion of said conforce spring means extending along said first side wall adjacent to but spaced form nose ends of the cartridges so that said unwound portion does not touch the cartridges and said wound portion of said conforce spring means being located near a front wall of said follower body, which is adjacent to the nose ends of the cartridges, said follower body including a rear wall opposite from said front wall, a first follower side wall and a second follower side wall with a support surface being defined by said front and rear walls and said first follower side and second follower side walls of said follower body, said support surface being a compound surface in which a first angle is defined using at least said rear wall and a second angle is defined using at leas one of said first and said second follower side walls of said follower body and wherein said first angle is in the range of 5°–15° and said second angle is int eh range of 20°–35°; and first rib means provided on said first side wall for engaging parts of the cartridges, said first rib means having a depth into said magazine chamber for use in providing said space between said unwound portion of said conforce spring means and the cartridges.

17. A magazine for housing cartridges, comprising:

a magazine body including a top portion, a bottom portion, front and rear end walls, firs and second side walls, each of said first and second side walls having a greater width than each of said front and rear end walls, said front and rear end walls and side walls defining a magazine chamber for storing cartridges;

a follower assembly including a follower body and spirally wound conforce spring means, said conforce spring means including at least a first conforce spring and a second conforce spring separate from said first conforce spring, said second conforce spring overlying and contacting substantial portions of said first conforce spring wherein increased spring force is provided along substantially the same longitudinal extent of said first side wall using said first and second conforce springs, said conforce spring means including a free end connected to said first side wall and, when said magazine body contains cartridges, said conforce spring means including an unwound portion and a wound portion, said unwound portion of said conforce spring means extending along said first side wall adjacent to but spaced form nose ends of the cartridges so that said unwound portion does not touch the cartridges and said wound portion of said conforce spring means being located near a front wall of said follower body which is adjacent to the nose ends of the cartridges; and first rib means provided on said first side wall for engaging parts of the cartridges, said first rib means having a depth into said magazine chamber for use in providing said space between said unwound portion of said conforce spring means and the cartridges.

18. A magazine for housing cartridges, comprising:

a magazine body including a top portion, a bottom portion, front and rear end walls, first and second side walls, each of said first and second side walls having a greater width than each of said front and rear end walls, said front and rear end walls and side walls defining a magazine chamber for storing cartridges;

a follower assembly including a follower body and a spirally wound conforce spring means, said follower body including a first wall having a first channel formed therein, said conforce spring means including a free end connected to said first side wall and, when said magazine body contains cartridges, said conforce spring means including an unwound portion and a wound portion, said unwound portion of said conforce spring means extending along said first side wall adjacent to but spaced form nose ends of the cartridges so that said unwound portion does not touch the cartridges and said wound portion of said conforce spring means being located near a front wall of said follower body, which is adjacent to the nose ends of the cartridges; and first rib means provided on said first side wall for engaging parts of the cartridges, said first rib means having a depth into said magazine chamber for use in providing said space between said unwound portion of said conforce spring means and the cartridges, and said first channel of said first wall of said follower body having a depth sufficient to prevent contact between said first rib means and said follower body.

19. A magazine for housing cartridges, comprising:

a magazine body including a top portion, a bottom portion, front and rear end walls, first and second side walls, each of said first and second side walls having a greater width than each of said front and rear end walls, said front and rear end walls and said walls defining a magazine chamber for storing cartridges;

a follower assembly including a follower body and spring means; and first, second and third latch areas formed in said magazine body, said second latch area including a jog relative to said third latch area and said second latch area being contiguously adjacent to said third latch area with said first latch area being spaced from said second and third latch areas, at least one of said latch areas for use with a latch of one of three different firearms that utilize nine millimeter cartridges.

* * * * *